US010047602B2

(12) United States Patent
Turner

(10) Patent No.: US 10,047,602 B2
(45) Date of Patent: Aug. 14, 2018

(54) ANTENNAS FOR A DRILLING SYSTEM AND METHOD OF MAKING SAME

(71) Applicant: APS Technology, Inc., Wallingford, CT (US)

(72) Inventor: William E. Turner, Durham, CT (US)

(73) Assignee: APS Technology, Inc., Wallingford, CT (US)

( * ) Notice: Subject to any disclaimer, the term of this patent is extended or adjusted under 35 U.S.C. 154(b) by 331 days.

(21) Appl. No.: 14/849,490

(22) Filed: Sep. 9, 2015

(65) Prior Publication Data

US 2017/0067336 A1 Mar. 9, 2017

(51) Int. Cl.
*E21B 47/12* (2012.01)
*E21B 17/02* (2006.01)

(52) U.S. Cl.
CPC ..... *E21B 47/122* (2013.01); *E21B 17/028* (2013.01)

(58) Field of Classification Search
CPC ..... E21B 47/12; E21B 47/122; E21B 17/028; G06K 19/04; G06K 19/07; G06K 19/23
USPC ..... 340/854.3, 854.6, 854.8; 343/788, 787; 166/65.1
See application file for complete search history.

(56) References Cited

U.S. PATENT DOCUMENTS 5,419,864 A * 5/1995 Sheer ..... B29C 43/14 264/254
5,495,237 A * 2/1996 Yuasa ..... E21B 23/00 175/50
6,811,857 B1 * 11/2004 Bravet ..... B29C 45/14811 428/192
2006/0270301 A1 * 11/2006 Marks ..... H01Q 1/288 442/316
2006/0290529 A1 * 12/2006 Flanagan ..... G01V 11/002 340/854.6

* cited by examiner

*Primary Examiner* — George S Gray
(74) *Attorney, Agent, or Firm* — Offit Kurman, P.A.; Gregory A. Grissett

(57) ABSTRACT

A system and method for assembling a communication system in a drilling system configured to drill a borehole in an earthen formation. The communication system has a first antenna assembly and a second antenna assembly that are communicatively coupled together. The method includes attaching a first antenna to the first drill string component and attaching a second antenna to a second antenna assembly. The communication system is configured such that the first drill string component and the second drill string component are communicatively coupled together.

24 Claims, 10 Drawing Sheets

ANTENNAS FOR A DRILLING SYSTEM AND METHOD OF MAKING SAME

TECHNICAL FIELD

The present disclosure relates to antennas for a drilling system, methods of making same, and methods of assembling a drilling system and components thereof.

BACKGROUND

Drilling systems for underground drilling operations are complex and difficult to control. Measurement-while-drilling (MWD) and logging-while-drilling (LWD) tools have been developed to capture drilling information regarding the drill head location, orientation, and formation properties during the drilling operation. Communication systems have been developed to capture data obtained by the MWD and LWD tools and transmit that data to the surface for further analysis. Such communication systems include wire line, mud pulse telemetry, electromagnetic telemetry, and acoustic telemetry systems. Drill string designs are increasingly complex. Bottom hole assemblies, in particular, may include vibration damping systems, MWD tool or LWD tool, mud motors, centralizers, passages for drilling mud, and various power modules. Data transfer mechanisms are needed between closely arranged components in the bottom hole assembly that can withstand the drilling environment.

SUMMARY

An embodiment of the present disclosure includes a system and method for assembling a communication system in a drilling system configured to drill a borehole in an earthen formation. The communication system has a first antenna assembly and a second antenna assembly that are communicatively coupled together. The method includes attaching a first antenna to the first drill string component and attaching a second antenna to a second antenna assembly. The communication system is configured such that the first drill string component and the second drill string component are communicatively coupled together.

BRIEF DESCRIPTION OF THE DRAWINGS

The foregoing summary, as well as the following detailed description of illustrative embodiments of the present application, will be better understood when read in conjunction with the appended drawings. For purposes of illustrating the present application, illustrative embodiments are shown in the drawings. It should be understood, however, that the application is not limited to the precise arrangements and instrumentalities shown. In the drawings.

DETAILED DESCRIPTION OF ILLUSTRATIVE EMBODIMENTS

Figure 1:
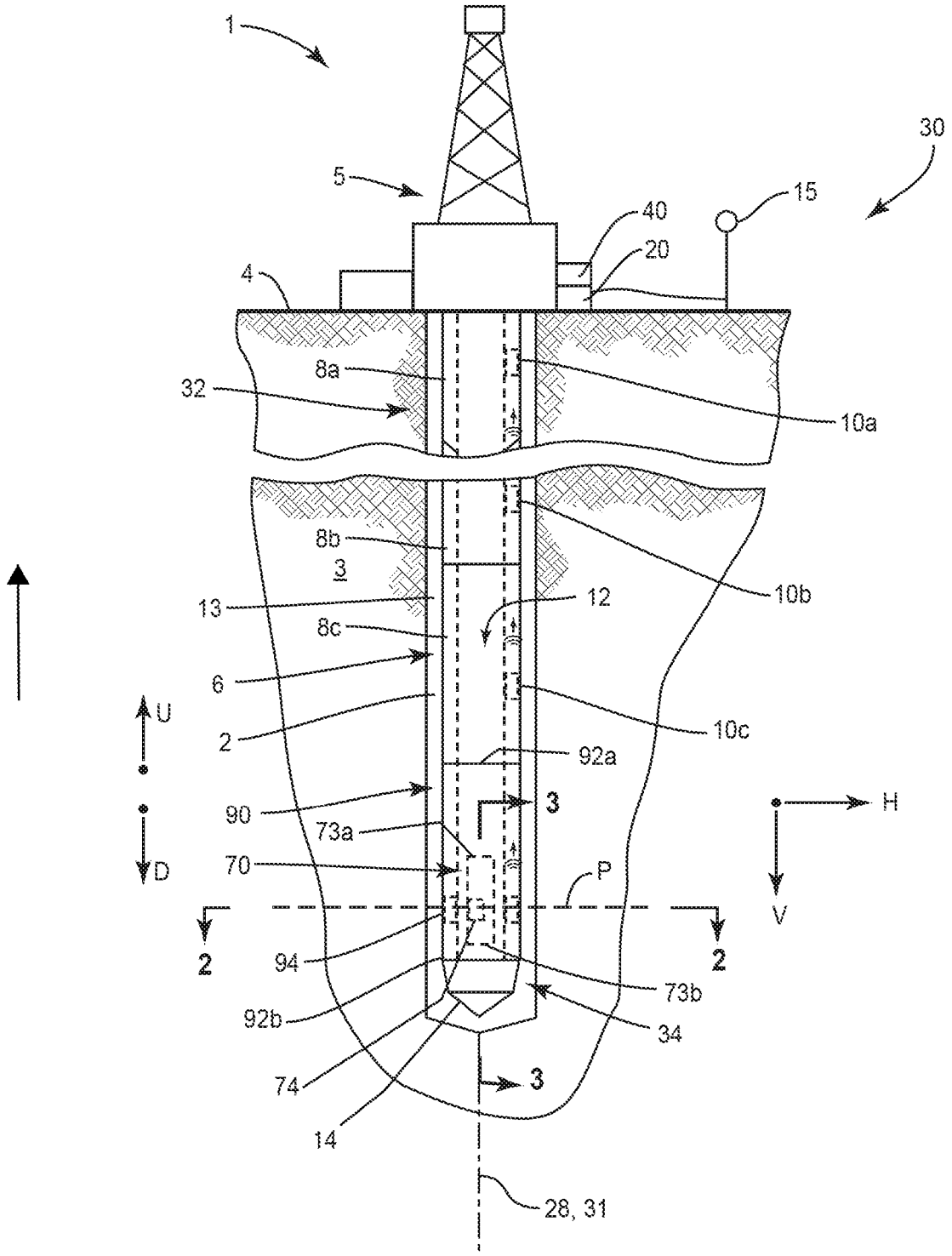
FIG. 1 is a schematic of a drilling system include a drill string according to an embodiment of the present disclosure.

Referring to FIG. 1, an embodiment of the present is a drilling system 1 including a drill string 6 configured to define a borehole 2 in an earthen formation during a drilling operation. The drilling system 1 includes an inner or first drill string component 70, such as a telemetry tool or sonde, that includes one or more antennas 74 supported along an outer surface thereof. The drilling system 1 can also include at least one outer or second drill string component 90 that includes one more antennas 94 supported along an inner surface thereof. The inner drill string component 70 is configured to be positioned at least partially inside the outer drill string component 90 in an assembled configuration at a drill site during make-up such that the first antenna 74 can be generally aligned with the second antenna 94 along a plane P. In the assembled configuration, the first and second antennas 74 and 94 are placed within wireless communicative range with each other. The first and second antennas 74 and 94 can then transmit signals between each other, as will be further detailed below. The result is a drill string 6 with components that facilitate transfer of drilling data via signals between closely arranged drill string components, e.g. between a sonde and an adjacent section of drill pipe. Further details regarding the drilling system 1 will be discussed next.

Continuing with FIG. 1, the drilling system 1 comprises a derrick 5, a drill string 6 supported and operably connected to the derrick 5, and a drill bit 14 carried by the drill string 6. The drilling system 1 also includes a communication system 30 and one or more computing devices 40. The communication system 30 facilitates the transmission and receipt of signals having encoded therein drilling data obtained via various sensors typically but not exclusively located downhole. The computing device 40 can be integrated with the communications system 30 and with various control systems used to operate the drilling system 1.

The derrick 5 can be any structure operably connected to and designed to support the drill string 6 during a drilling operation. One or more motors (not shown), such as a top drive or rotary table, located at the derrick 5 are configured to rotate the drill string 6 so as to control the rotational speed (RPM) of, and torque on, the drill bit 14. One or more motors can rotate the drill string 6 and drill bit 14 to define the borehole 2. A pump (not shown) is configured to pump a fluid (drilling mud, drilling with air, foam (or aerated mud)) downward through an internal passage 12 in the drill string 6. When the drilling mud exits the drill string 6 at the drill bit 14, the returning drilling mud flows upward toward the surface 4 through an annular passage 13 formed between the drill string 6 and a wall 11 of the borehole 2 in the earthen formation 3. Optionally, a mud motor may be disposed downhole to rotate the drill bit 14 independent of the rotation of the drill string 6.

The drill string 6 includes several drill string components. Drill string components may include one or more subs, stabilizers, drill string segments, drill collars, a bottomhole assembly (BHA) (not shown), steering assemblies (not shown), telemetry tools, such as a sonde, or other measurement or logging tool. The drill string components can be assembled at the drill site during the make-up operation to define the drill string 6 and the internal passage 12 through which drill mud travels in a downhole direction D. The drill string 6 can be elongate along a longitudinal axis 31 and includes a top end 32 and a bottom end 34 spaced from the top end 32 along the longitudinal axis 31. The internal passage 12 extends from the top end 32 to the bottom end 34. The top end 32 of the drill string 6 can be operatively supported by derrick 5. In accordance with the illustrated embodiment, the drill string 6 includes at least one inner drill string component 70, the outer drill string component 90, and a plurality of additional drill string components 8*a*, 8*b*, 8*c*, etc. Drill string components 8*a*, 8*b*, 8*c*, and 90 can be connected end-to-end along the longitudinal axis 31 during a make-up operation at the drill site as the drill bit 14 progresses into the earthen formation 3.

During the drilling operation, the drilling system 1 is configured to drill the borehole 2 into the earthen formation 3 along a vertical direction V or optionally along a horizontal direction H along a bore hole central axis 28 such that the axis 28 extends at least partially along a vertical direction V. The vertical direction V refers to a direction that is perpendicular to the surface 4 of the earthen formation 3. It should be appreciated that the drill string 6 can be configured for directional drilling, whereby all or a portion of the borehole 2 is angularly offset with respect to the vertical direction V along a horizontal direction H. The horizontal direction H is mostly perpendicular to the vertical direction V so as to be aligned with or parallel to the surface 4. The terms "horizontal" and "vertical" are used herein as understood in the drilling field, and are approximations. Thus, the horizontal direction H can extend along any direction that is perpendicular to the vertical direction V, for instance north, east, south and west, as well as any incremental direction between north, east, south and west. Further, downhole or downhole location means a location closer to the bottom end 34 of the drill string 6 than the top end 32 of the drill string 6. Accordingly, a downhole direction D refers to the direction from the surface 4 toward a bottom end (not numbered) of the borehole 2, while an uphole direction U refers the direction from the bottom end of the borehole 2 toward the surface 4. The downhole and uphole directions D and H can be curvilinear for directional drilling operations. Thus, the drilling direction or well path extends partially along the vertical direction V and the horizontal direction H in any particular geographic direction as noted above.

Continuing with FIG. 1, the communication system 30 is configured to transmit and receive signals carrying drilling data obtained during the drilling operation. For instance, the communication system 30 transmits drilling data from a downhole location of the borehole 2 to the surface 4. The communication system 30 can also transmit drilling data from the surface toward the downhole location. Thus, the communication system 30 can be configured for uplink and downlink operations. The communication system 30 can include a telemetry tool, a receiver assembly 20, and one or more of the antennas. The telemetry tool can be referred to as a drill string component 70. The antennas can include uphole or surface antennas 15 and a plurality of downhole antennas. The downhole antennas can include antennas 74 and 94 as well as additional antennas 10*a*, 10*b*, and 10*c* positioned along the drill string 6, as further detailed below.

The receiver assembly 20 includes components that can detect signals transmitted via the antennas and can process the received signals into a format suitable for further analysis via a computing device. The receiver assembly 20 can be in electronic communication with the surface antennas 15 and one or more of the downhole antennas 10*a*-10*c*, 74, and 94.

The surface antennas 15 (one shown) are in electronic communication with receiver assembly 20 and the computing device 40. The surface antennas 15 can be any conductive member, such as a wire, metal stake, pair of stakes, a conductive portion of the drill string, such as the blow-out preventer (BOP) or casing (BOP and casing not shown).

The downhole antennas 10*a*, 10*b*, and 10*c*, 74 and 94 are configured to transmit, receive, and relay communications signals to the receiver assembly 20 and computing device 40. In accordance with the illustrated embodiment, each antenna 10*a*, 10*b*, and 10*c* is spaced from one another such that adjacent antennas are within a communicative range with each other. The spacing between the antennas 10*a*, 10*b*, and 10*c* may be selected based on the data transmission and receiving capabilities of the antenna design, e.g., signal range. The downhole antenna 10*c* can be in electronic communication with the antenna 94. Antenna 10*b* can be in communication with the antenna 10*c* and antenna 10*a* can be in electronic communication with antenna 10*a*. Antenna 10*a* can be coupled to receiver assembly 20 via a wired or wireless connection (wired connection not shown). Depending on the length of the drill string 6 and signal range, additional antennas can be located in between antennas 10*a*, 10*b* and 10*c*. Antennas 10*a*, 10*b*, and 10*c* may be coupled to drill string 6 along the internal passage 12 by any typical means, for instance, mechanical or adhesive coupling.

In alternative embodiments, one or more of the downhole antennas can be in electronic communication with a telemetry system located downhole. The downhole telemetry system can be a mud pulse telemetry system, an acoustic telemetry system, or an EM telemetry system. The telemetry system can receive drilling data from the antennas and then transmit the drilling data to receiver assembly 20 and computing device 40. For instance, the first antenna 74 can transmit drilling data to second antenna 94 and antenna 94 can transmit drilling data to the telemetry system directly or via one or more antennas 10*a*, 10*b*, and 10*c*. The telemetry system can then transmit drill data to the surface 4 for detection and processing. Further, drilling data can be transmitted downhole via the telemetry system or the antennas 10*a*, 10*b* and 10*c* to antenna 94.

The computing device 40 can be any suitable computing device configured to host software applications that can process and analyze drilling data. The computing device 40 includes a processing portion, a memory portion, an input/output portion, and a user interface (UI) portion. It should be understood that the computing device 40 can include any appropriate device, examples of which include a desktop computing device, a server computing device, or a portable computing device, such as a laptop, tablet or smart phone.

Figure 2:
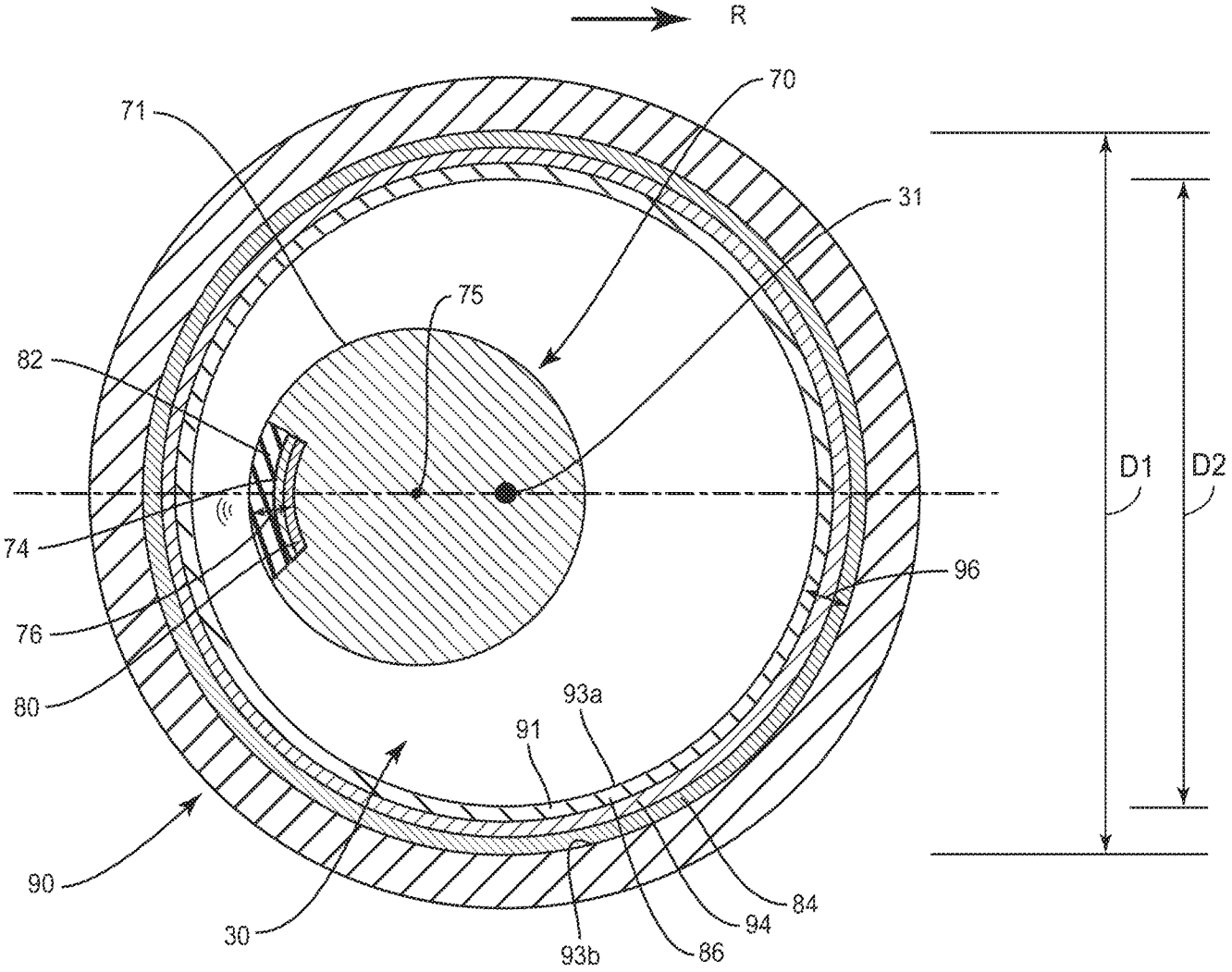
FIG. 2 is a schematic cross-sectional view of the a portion of the drill string, taken along line 2-2 in FIG. 1.
Figure 3A:
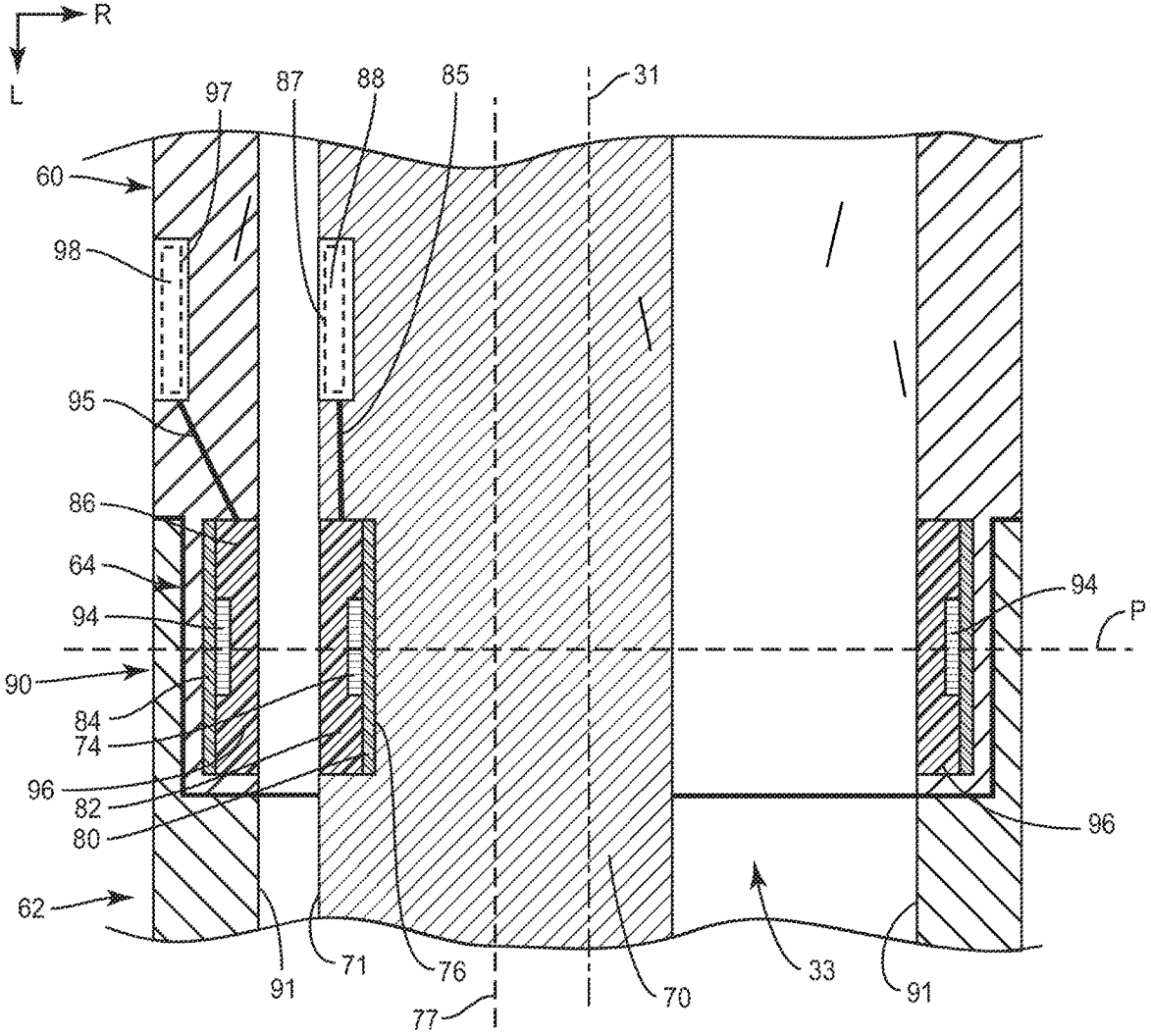
FIG. 3A is a schematic cross-sectional view of a portion of the drill string shown in FIG. 1, taken along lines 3-3 in FIG. 1, illustrating first and second antennas supported by respective inner and outer drill string components.

Turning to FIGS. 2 and 3A, the inner drill string component 70 as noted above can be telemetry tool or a sonde 70, and is configured to place inside the outer drill string component 90 (or drill string component 190 shown in FIG. 4A) such that antennas 74 and 94 are aligned along the plane P. It should be appreciated the sonde 90 can be placed in the outer drill string component 90 such that the antennas 74 and 94 are offset with respect to each other yet are still within communicative range with each other. The sonde 70 includes an uphole end 73*a* and a downhole end 73*b* spaced from the uphole along a sonde axis 77 (uphole and downhole ends 73*a* and 73*b* shown in FIG. 1). The sonde axis 77 passes the a geometric center 75 of the sonde 70. The sonde 70 defines a sonde outer surface 71 that faces an inner surface 91 of the outer drill string component 90 when the sonde 70 and outer drill string component 90 are assembled at the drill site.

Continuing with FIG. 2, the outer surface 71 of the sonde 70 defines a recess 76 configured support the first antenna 74. The first antenna 74 can be formed in the recess 76 as further discussed below. In accordance with the illustrated embodiment, the recess 76 extends toward the central 77 along a radial direction R that is perpendicular to the longitudinal direction L. In addition, the recess 76 can extend along a rotational direction (not shown) relative to the axis 77 along a portion of the sonde 70. For instance, the recess 76 can extend less than 360 degrees around the axis 77 along the rotation direction. In other embodiments, the recess 76 can be a circumferential recess (not shown) that extends around an entirety of the outer surface 71 of the sonde 70 along the rotational direction about the axis 77. The recess 76 can have any particular orientation relative to the axis 77 or shape suitable for supporting at least a portion of an antenna. The sonde 70 can also define a pocket 87 sized and configured to contain an electronics package 88 and one more wire passageways 85. The passageways 85 can route electrical leads from the antenna 74 to the electronics package 88. The electronics package 88 can include a power source, micro-controller, and other electronic components that facilitate transmission and receipt of the drilling data. For instance, the antenna 74 and electronics package can be configured as a receiver, a transmitter, a transceiver and a transmitter-receiver. As illustrated, the first antenna 74 can be positioned toward downhole most end 73*b* of the sonde 70. In other embodiments, the first antenna 74 may be located further uphole on the sonde 70.

Continuing with FIGS. 2 and 3A, the first antenna 74 can be encapsulated in at least one elastomeric material in the recess 76. In accordance with the illustrated embodiment, the at least one elastomeric material can include a first elastomeric material 80 and a second elastomeric material 82 which encapsulate the antenna 74. The first and second elastomeric materials 80 and 82 can be similar to each other or different materials. The elastomeric materials may include any type of elastomer, such as elastomeric thermosets or elastomeric thermoplastics. Details regarding how the antenna 74 is attached to sonde 70 with the elastomeric materials are detailed below.

Turning to FIGS. 2 and 3A, the inner drill string component 70 can include one or more sensors configured to obtain drilling data, a power source, a modulating device (not shown), and a transmitter. The sensors obtain certain drilling parameters, such as directional information, tool face angle, vibration data, etc., during the drilling operation. The modulating device encodes the drilling data into an encoded signal. The transmitter transmits the encoded signal to the surface 4 via one or more antennas 74 and 94. The telemetry tool is supported within the drill string 6 and may span multiple drill string components. The telemetry tool is sometimes referred to herein as a measurement-while-drilling (MWD) tool, although the telemetry tool could also be a logging-while-drilling (LWD) type tool.

Figure 3B:
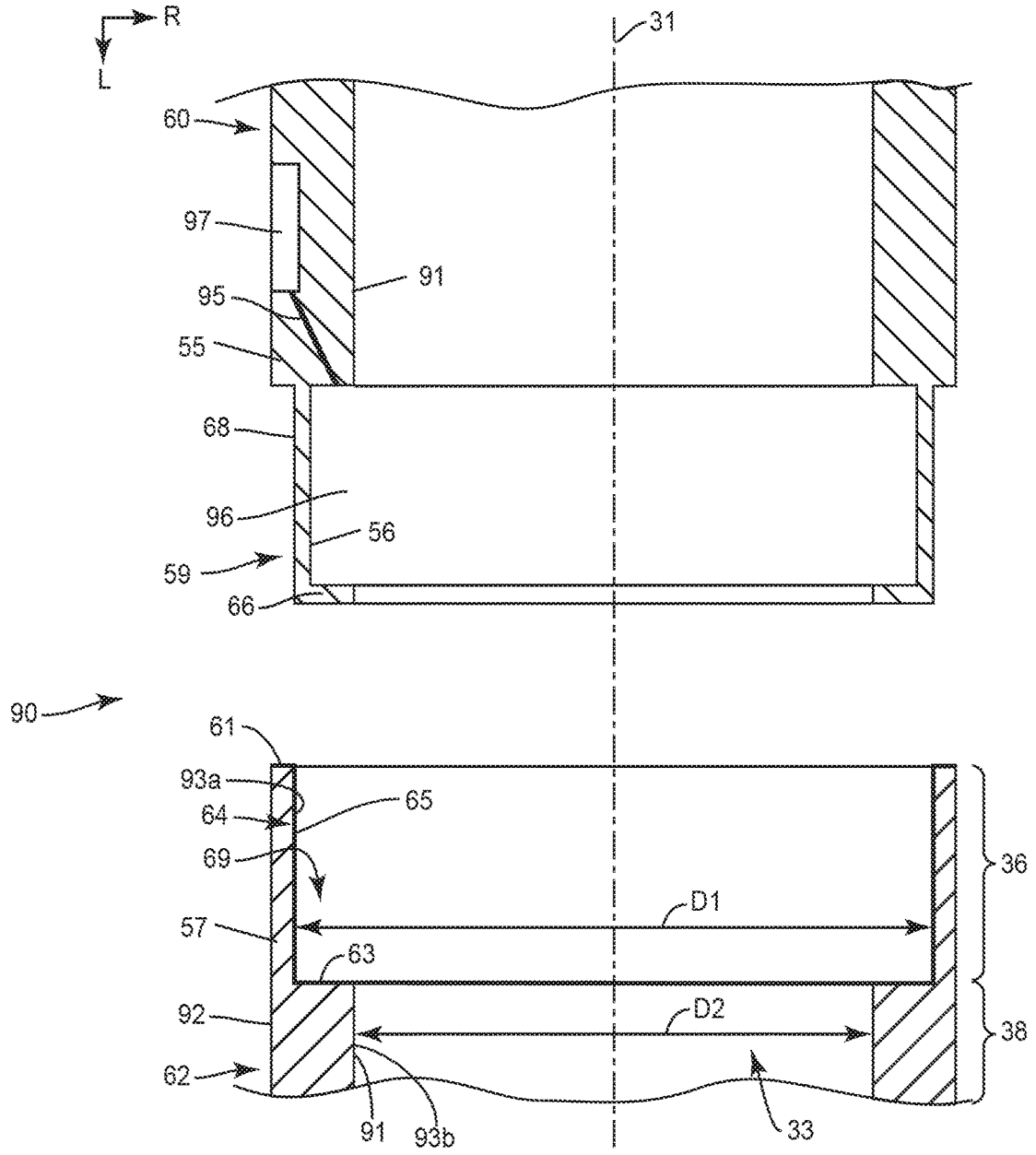
FIG. 3B is a schematic cross-sectional assembly view of the outer drill string component shown in FIG. 3A, illustrating the outer drill string component without its respective antenna.

Continuing with FIGS. 2, 3A and 3B, the outer drill string component 90 can be manufactured in such a way that antenna 94 is within communicative range of the antenna 74 when the sonde 70 and outer drill string components 90 are assembled. The outer drill string component 90 includes an uphole end 92*a*, a downhole end 92*b* spaced from the uphole end 92*a* along the central axis 31. The outer drill string component 90 has an inner surface 91 and an opposed outer surface 92. The inner surface 91 at least partially defines passage 33, which is a portion of the internal passage 12. The inner surface 91 is configured to face the sonde outer surface 71 when the sonde 70 and outer drill string component 90 are assembled such that outer surface 92 face the borehole wall during drilling.

The outer drill string component 90 can also include at least one sub. As illustrated, the outer drill string component 90 can include a downhole sub 62, an uphole sub 60 coupled to the downhole sub at sub interface 64. The downhole sub 62 can be referred to as a first sub 62 and the uphole sub can be referred to as a second sub 60. The sub interface 64 can be a threaded connection, fastener, or any structure that can connect the uphole sub 60 to the downhole sub 62. The downhole and uphole subs 60 and 62 connected together define the inner surface 91.

Continuing with FIGS. 2, 3A and 3B, the inner surface 91 of drill string component 90 defines a recess 96 configured support the outer antenna 94. The outer antenna 94 can be formed in the recess 96 as further discussed below. In accordance with the illustrated embodiment, the recess 96 extends around at least a portion of the inner surface 91 of drill string component 90. In accordance with the illustrated embodiment, the recess 96 extends around the entirety of the inner surface 91, such that recess extends 360 degrees around the axis 31 in a rotational direction about axis 31. In other embodiments, however, the recess 96 can extend around less than 360 degrees around the axis 31. The drill string component 90 can also define a pocket 97 sized and configured to contain an electronics package 98 and one more wire passageways 95. The passageways 95 can route electrical leads from the antenna 94 to the electronics package 98. The electronics package 98 can include a power source, micro-controller, and other electronic components configured facilitate transmission and receipt of data by the antenna. For instance, the antenna 94 and electronics package 98 can be configured as a receiver, a transmitter, a transceiver, and a transmitter-receiver. As illustrated, the first antenna 94 can be positioned toward downhole most end 92*b* of the outer drill string component 90. In other embodiments, the second antenna 94 may be located further uphole along the drill string component 90.

Turning to FIGS. 3A and 3B, the uphole sub 60 is configured to support the antenna 94. The uphole sub 60 includes a top end 92*a*, an opposed end 66 spaced from end 92*a*, and a wall 55 that extends along the longitudinal direction L between ends 92*a* and 66. The wall 55 includes an inner surface 56 and an opposed outer surface 68. A downhole portion 59 of the wall 55 adjacent to the end 66 has a contracted perimeter along the outer surface 68. The wall inner surface 56 defines the recess 96 aligned with the contracted downhole portion and adjacent the end 66. This arrangement results in access to the recess 96 suitable for installing the antenna 94 in the recess 96, as further detailed below. Further, the outer surface 68 of the downhole portion can be threaded so as to threadably engage the downhole sub 62. The downhole portion 59 can define any particular type structure along surface 68 that can connect to the downhole sub 62. For instance, the downhole portion 59 can be threaded along the outer surface 68.

The second antenna 94 can be encapsulated in at least one elastomeric material in the recess 96. The at least one elastomeric material can include a first elastomeric material 84 and a second elastomeric material 86 which encapsulate the antenna 94. The first and second elastomeric materials 84 and 86 can be similar to each other or different materials. The elastomeric materials may include any type of elastomer, such as elastomeric thermosets or elastomeric thermoplastics.

Continuing with FIG. 3B, the downhole sub 62 is configured to receive the uphole sub 60. The downhole sub 62 includes a top end 61 opposed to the downhole end 92*b* (not shown in FIG. 3B) along the longitudinal direction L, and a sub wall 57 that extends between end 61 and component end 92*b* (end 92*b* not shown in FIG. 3B), and a cutout 69 configured to receive the uphole sub 60. The downhole sub 62 includes an inner surface 65 having an upper portion 93*a* and a lower portion 93*b*, each of which define the passage 33. The upper portion 93*a* of the inner surface 65 defines the cutout 69. In this regard, it can be said the passage 33 includes a uphole passage portion 36 and a downhole passage portion 38 spaced apart along a longitudinal direction L such that the uphole passage portion 36 is aligned with the cutout 69. The downhole passage portion 38 is defined by the inner surface portion 93*b*. In accordance with the illustrated embodiment, the uphole passage portion 36 has a first cross-sectional dimension D1 that extends between and from opposed points (not shown) of the wall 57 aligned with the cutout 69. The first cross-sectional dimension D1 extends along a radial direction R that is perpendicular to the longitudinal direction L and axis 31. The downhole passage portion 38 has a second cross-sectional dimension D2 that extends between and from opposed points (not shown) of the lower surface portion 93*b*. The second cross-sectional dimension D2 extends along the radial direction R. The first cross-sectional dimension D1 is greater than the second cross-sectional dimension D2. The sub 62 defines a stop face 63 disposed between the uphole and downhole passage portions 36 and 38

Referring to FIG. 3A, in accordance with the illustrated embodiment, coupling of subs 60 and 62 at the interface 64 define the outer drill string component 90. The uphole sub 60 defines the recess 96 that is adjacent sub downhole end 66. The downhole sub 62 defines a cutout 69 configured to receive the sub 60. When the subs 60 and 62 are connected at the interface 64, the recess 96 and the encapsulated antenna 94 is positioned in the upper passage portion 36 of the downhole sub 60. Accordingly, subs 60 and 62 when coupled together can define the outer drill string component inner surface 91. In this regard, the antenna 94 can be attached to the outer drill string component along the drill string component inner surface 91. While the outer drill string component 90 is described as having sub 60 and sub 62, sub 60 and 62 can be considered a drill string components.

Figure 4A:
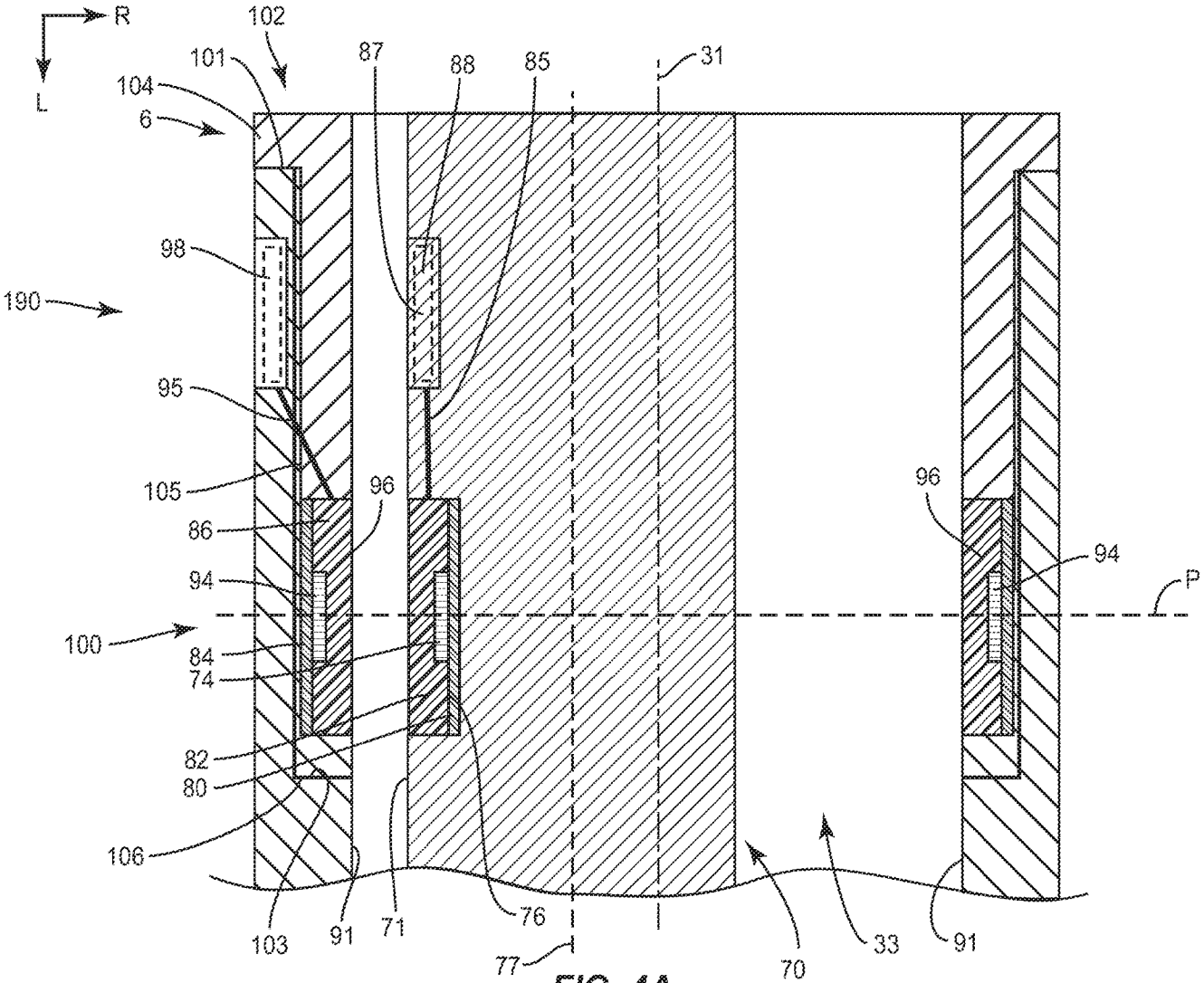
FIG. 4A is a schematic cross-sectional view a portion of drill string shown in FIG. 1, illustrating first and second antennas supported by respective inner and outer string components according to another embodiment of the present disclosure.
Figure 4B:
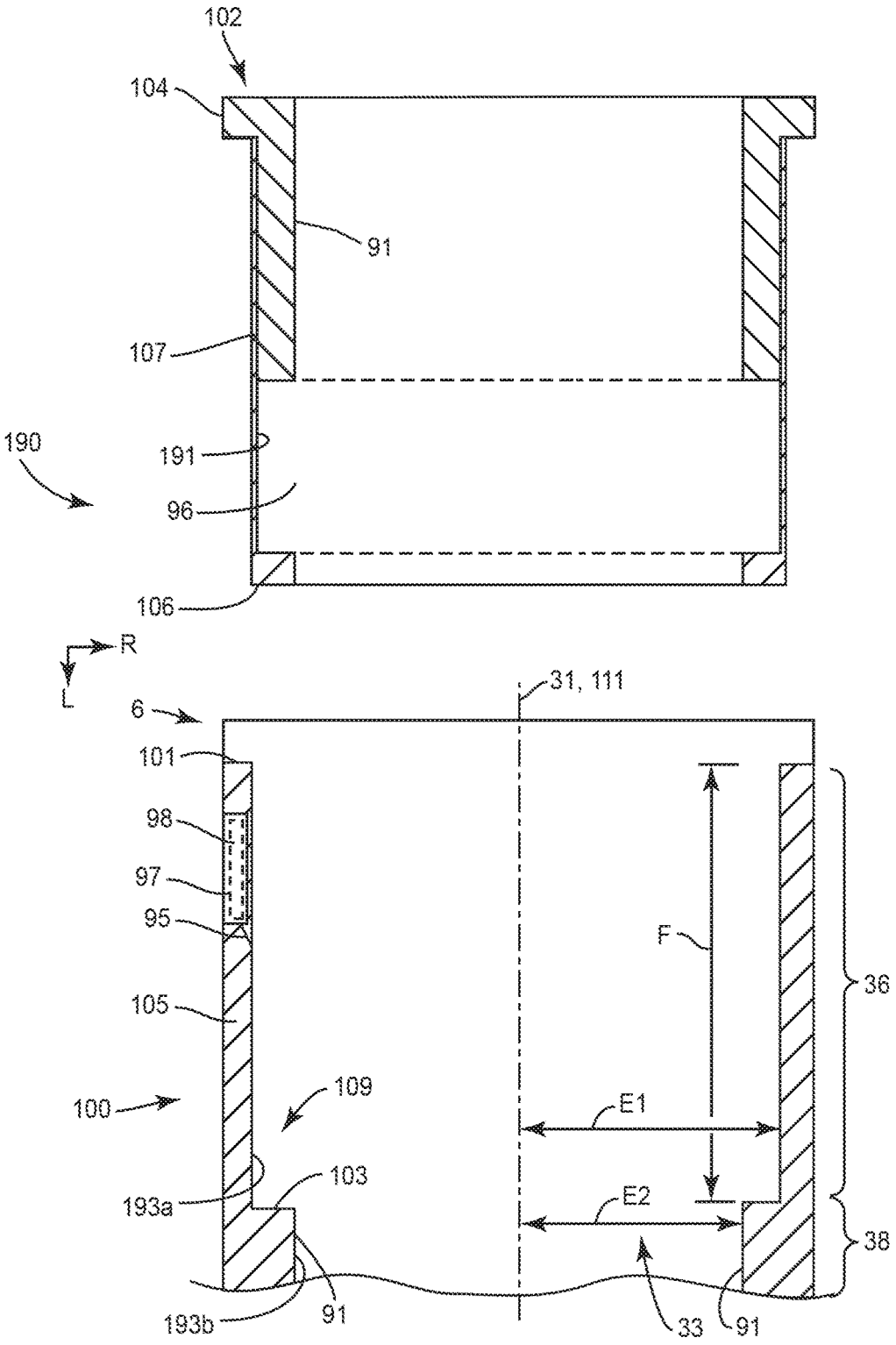
FIG. 4B is a schematic cross-sectional assembly view of the outer drill string component shown in FIG. 4A, illustrating the outer drill string component without its respective antenna.

Turning to FIGS. 4A and 4B, the drilling system 1 can include an outer drill string component 190 according to another embodiment of the present disclosure. The outer drill string component 190 is configured similarly to the outer drill string component 90 and similar reference signs are used to identify elements that are common to outer drill string components 90 and 190. For instance, the outer drill string component 190 includes an inner surface 91, a recess 96 and an antenna 94 disposed in the recess 96. As shown in FIG. 4A, the antenna 94 is encapsulated in an at least one elastomeric material. For instance, the first and second elastomeric materials 84 and 86. Further, the outer drill string component 190 includes pocket 87, an electronics package 88, and passageways 85, as described above. For instance, the antenna 74 and electronics package 88 can be configured as a receiver, a transmitter, a transceiver, or a transmitter-receiver, as described above. In accordance with the illustrated embodiment, the outer drill string component 190 includes an insert or first sub 102 and a downhole or second sub 100. The uphole insert sub 102 is configured to fit at least partially within the downhole sub 100.

Continuing with FIGS. 4A and 4B, the downhole sub 100 includes an uphole end 101 and a downhole end (not shown), a sub wall 105 that extends between the uphole and downhole ends along an axis 111 align with the longitudinal direction L, and a cutout 109. The downhole sub 100 defines internal passage 33 having an uphole passage portion 36 and a downhole passage portion 38 spaced from the uphole portion 36 in the longitudinal direction L, similar to the embodiment shown in FIGS. 3A and 3B. The sub 100 defines a stop face 103 disposed between the uphole and downhole passage portions 36 and 38. The downhole sub 100 further defines the inner surface 91 that includes a first inner surface portion 193*a* and a second inner surface portion 193*b*. The uphole passage portion 36 is defined by the inner surface portion 193*a* and the downhole passage portion 38 is defined by the inner surface portion 193*b*. The sub wall 105 and stop face 103 can define the cutout 109. The cutout 109 extends along a length F of the passage portion 36 between and from end 101 to the stop face 103. The cutout 109 is sized to receive the insert 102 such that the sub 100 and insert 102 define the component inner surface 91. The sub wall 105 can also define the pocket 97 and a portion of the passageway 95. In accordance with the illustrated embodiment, the uphole passage portion 36 has a first dimension E1 that extends from a central axis 111 to a point (not shown) on the inner surface portion 193*a*. The first dimension E1 extends along a radial direction R that is perpendicular to the longitudinal direction L and axis 31. The downhole passage portion 38 has a second dimension E2 that extends from a central axis 111 to a point (not shown) of the inner surface portion 193*b*. The central axis 111 can be the geometric center of the drill sting component 190 lying in a plane perpendicular to the longitudinal direction L. The second dimension E2 extends along the radial direction R. The first dimension E1 is greater than the second dimension E2. In accordance with the illustrated embodiment, the cutout 109 does not extend around an entirety of the sub 100 along a rotation direction. For instance, the cutout 109 is defined along about half of an inner perimeter of the sub 100. Further, the cutout 109 can extend along less than half of the inner perimeter of the sub 100.

Continuing with FIG. 4B, the insert sub 102 is configured to be positioned in the cutout 109 of the downhole sub 100. The insert 102 includes first or uphole end 104, an opposed second or downhole end 106, and a sub wall 107 that extends from the uphole end 104 to the second end 106. The sub wall 107 defines an inner surface 191. The uphole end 104 can define a ledge (not numbered) that is configured to abut the end 101 of the downhole sub 100. Wall 107 is sized such that the downhole end 104 is abut the stop face 103 of the downhole sub 100 when the ledge abut the end 101. The wall 107, e.g. the inner surface 191, can at least partially define the recess 96. In accordance with the illustrated embodiment, the recess 96 extends along an entirety of wall 107 in a rotational direction (not shown) that is perpendicular to the longitudinal direction L. However, the recess 96 can extend along a portion of the wall 107. Further, the insert sub 102 is constructed so as to facilitate attaching the antenna 94 within the recess 96, as shown in FIG. 4A. For instance, the recess 96 disposed adjacent to the sub downhole end 106 so as to provide access to the recess 96 and facilitate encapsulation of the antenna 94 within the elastomeric materials 84 and 86 in the recess 96.

The insert sub 102 is sized and configured to mate with an fit any shape of the cutout 109 as desired. For instance, if the cutout 109 extends 360 degrees about the central axis 111, then the insert 102 can be constructed as a tubular insert. If the cutout 109 extends around the axis 111 less than 360 degrees, the insert 102 is constructed accordingly. The insert 102 can be an elongate shape that fits within a narrow width cutout 109, a tubular shape that fits within a circumferential cutout 109 (not shown), or any other shape curved with respect to axis 111 that mates with the curvature and extent of the cutout 109.

As shown in FIGS. 2 and 3A and 4A, the sonde 70 is configured to be positioned in the drill string 6 so as to permit a signal to be transmitted from the first antenna 74 to the second antenna 94 and from the first antenna 74 to the second antenna 94. In accordance with the illustrated embodiment, the sonde 70 can be positioned in the passage 12 offset from the central axis 31 of the drill string 6 such that the antenna 74 is positioned closer the a portion of antenna 94 in the outer drill string component. For instance, the central axis 77 can be offset from the central axis 31 along a radial direction R that is perpendicular to the longitudinal direction L. Thus, the inner and outer drill string components 70 and 90, 190 are configured such that when the drill string 6 is assembled at the drill site, the first antenna 74 will be aligned with the second antenna 94 along the plane P. The present disclosure includes methods for manufacturing the inner and outer drill string components 70, 90, 190, such that when the inner and outer drill string component are assembled for a drilling operation, the first and second antennas 74 and 94 are spaced from each other a distance within the desired signal range of each antenna. In some embodiments, it may be preferable to align the antennas along the plane P, as noted above. However, during a drilling or make-up, the drill string components may shift slightly causing on offset between the antennas 74 and 94. In some cases, the drill operator may need to modify the drill string components subs such that axial offset results despite the designed in alignment along plane P. The ability of the antennas 74 and 64 to transmit and receive signal from each other outside of the precise axial alignment with the plane P may be needed, depending on drilling conditions.

Figure 5:
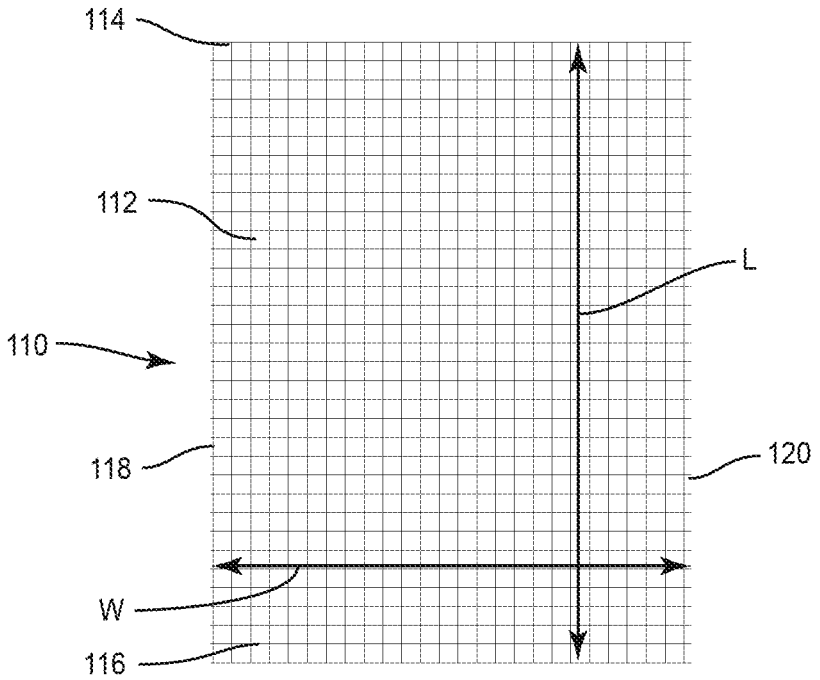
FIG. 5 is a schematic view of a wire assembly for use in an antenna shown in FIGS. 2-4B.
Figure 6:
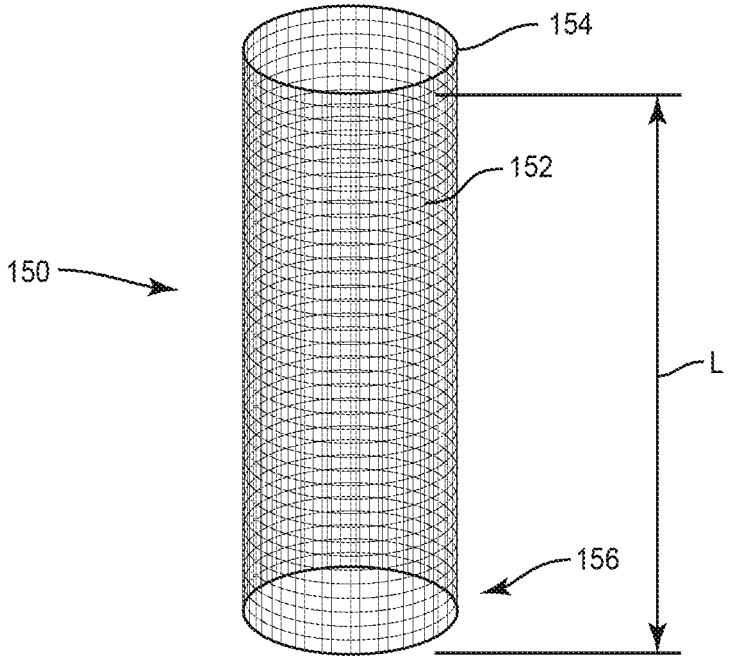
FIG. 6 is a schematic view of a wire assembly according another embodiment of the present.

Turning to FIG. 5, the first and second antennas 74 and 94 can be constructed as flat wire mesh 110 having a mesh body 112, opposed ends 114 and 116, and opposed sides 118 and 120. The wire mesh can be constructed of one or more wire strands. The wire strands can be any conductive material, such as copper, brass, etc. The wire strands can be arranged in grid pattern or woven to define the mesh body 112. Further, each wire strand can include a polymeric coating, as needed. The wire mesh 110 can have a length that extends between ends 114 and 116 that fits within a length L of a recess 76 along the longitudinal direction L. Further, the wire mesh 110 can have width W that extends from and between the opposed sides 118 and 120. The wire mesh width W is selected to fit within a width of the groove that extends along a direction perpendicular to the longitudinal direction L. The wire mesh 110 can be formed to fit within groove 76 that extends around a portion of the outer surface 71, or in circumferential groove (not shown) that extends around an entirety of the outer surface 71 of the sonde. In another embodiment, as shown in FIG. 6, the first antenna 74 or 94 may have the shape of a cylindrical wire mesh 150. The wire mesh includes a wire body 152 having a first end 152 and an opposed second end 154 spaced from the first end along the longitudinal direction L. The cylindrical wire mesh 150 can be sized to fit within circumferential recess (not shown) of the drill sting component. It should be appreciated that different configurations of wire antennas may be used. For instance, the antenna 74 and 94 can be monolithic wire.

Figure 7:
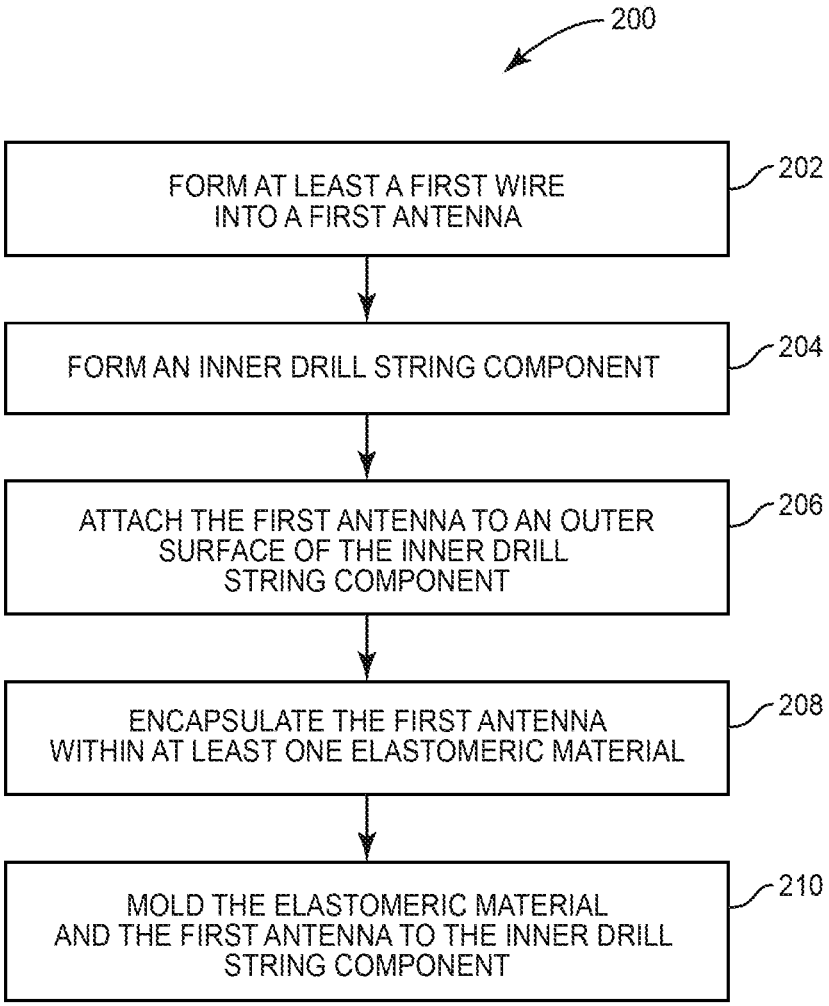
FIG. 7 is a diagram illustrating a method for manufacturing the inner drill string component including the first antenna, as illustrated in FIG. 1.

Turning now to FIG. 7, a method 200 of manufacturing the drill string component 70 includes a forming step 202 whereby at least one wire is formed into the antenna 74. The antenna forming step can include coating the wire with a polymeric coat and assembling wire strands into the desired wire mesh configuration. The forming step 204 includes fabricating or manufacturing the first drill string component 70 using techniques typical for manufacturing downhole tools for a drilling system. In accordance with the illustrated embodiment, the forming step 204 can include forming the recess 76 into the outer surface 71 of the drill string component 70. In addition, the forming step 204 can include incorporating other elements, such as sensors, electronics, and the like on the component body. Step 206 includes attaching the antenna along an outer surface of a first drill string component 70. Step 208 includes encapsulating the antenna within at least one elastomeric material in the recess 76. Encapsulation can include depositing the first elastomeric material in a recess 76, positioning the antenna at least partially in the first elastomeric material, and then depositing the second elastomeric material in the recess 76 such that the antenna 74 is encapsulated by the first elastomeric material and the second elastomeric material. During step 210, the elastomeric material and antenna 74 are compression molded in the recess 76. For instance compression molding can include placing the elastomeric materials under pressure and allowing the elastomers to set or cure. Thermal cure steps may be need depending on the type of elastomer used. The method 200 can include electronically connecting the antenna 74 to the electronic packages 88. For instance, wires can be routed through the passages 85 such that the antenna 74 can coupled to the electronics located in the pocket 87.

Figure 8:
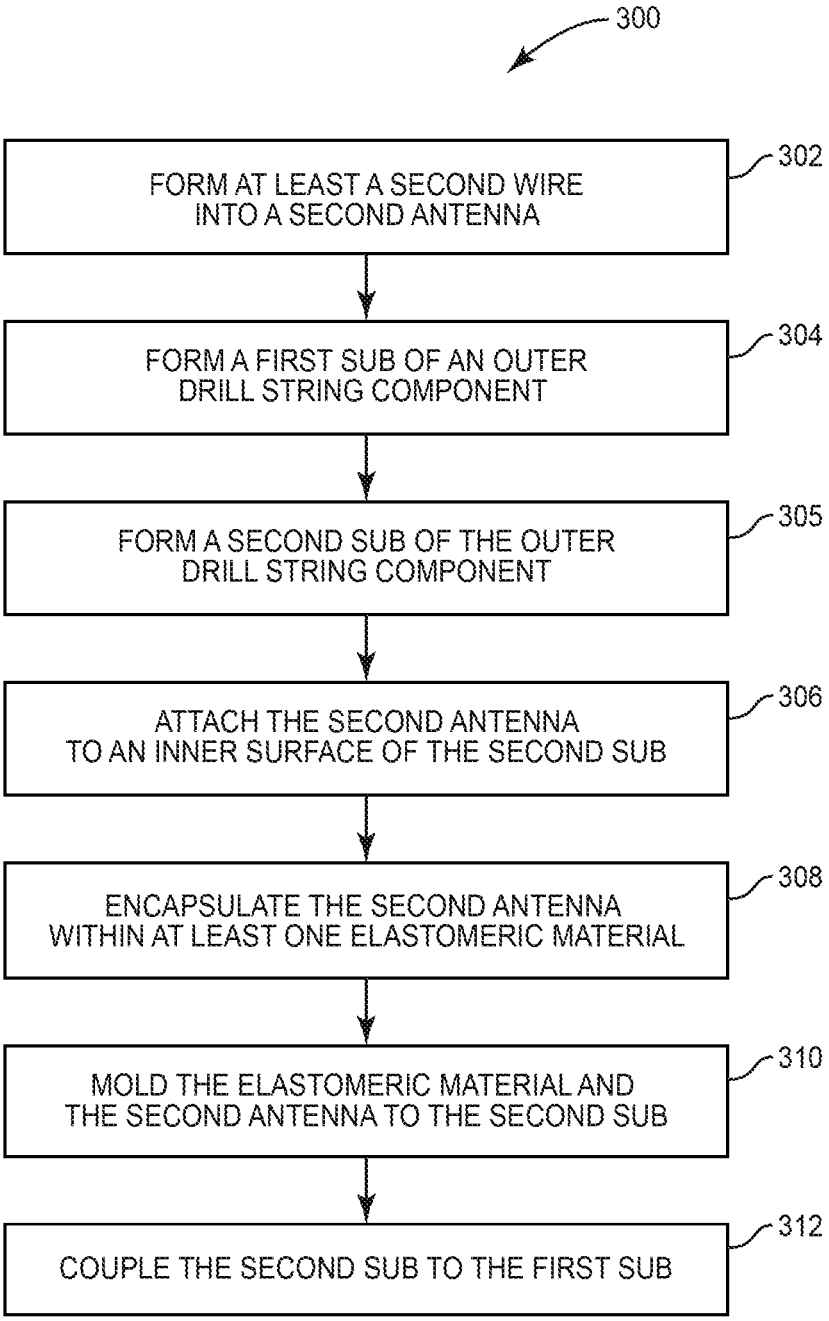
FIG. 8 is a process flow diagram illustrating a method for manufacturing the outer drill string component including the second antenna shown in FIGS. 3A and 3B.
Figure 9:
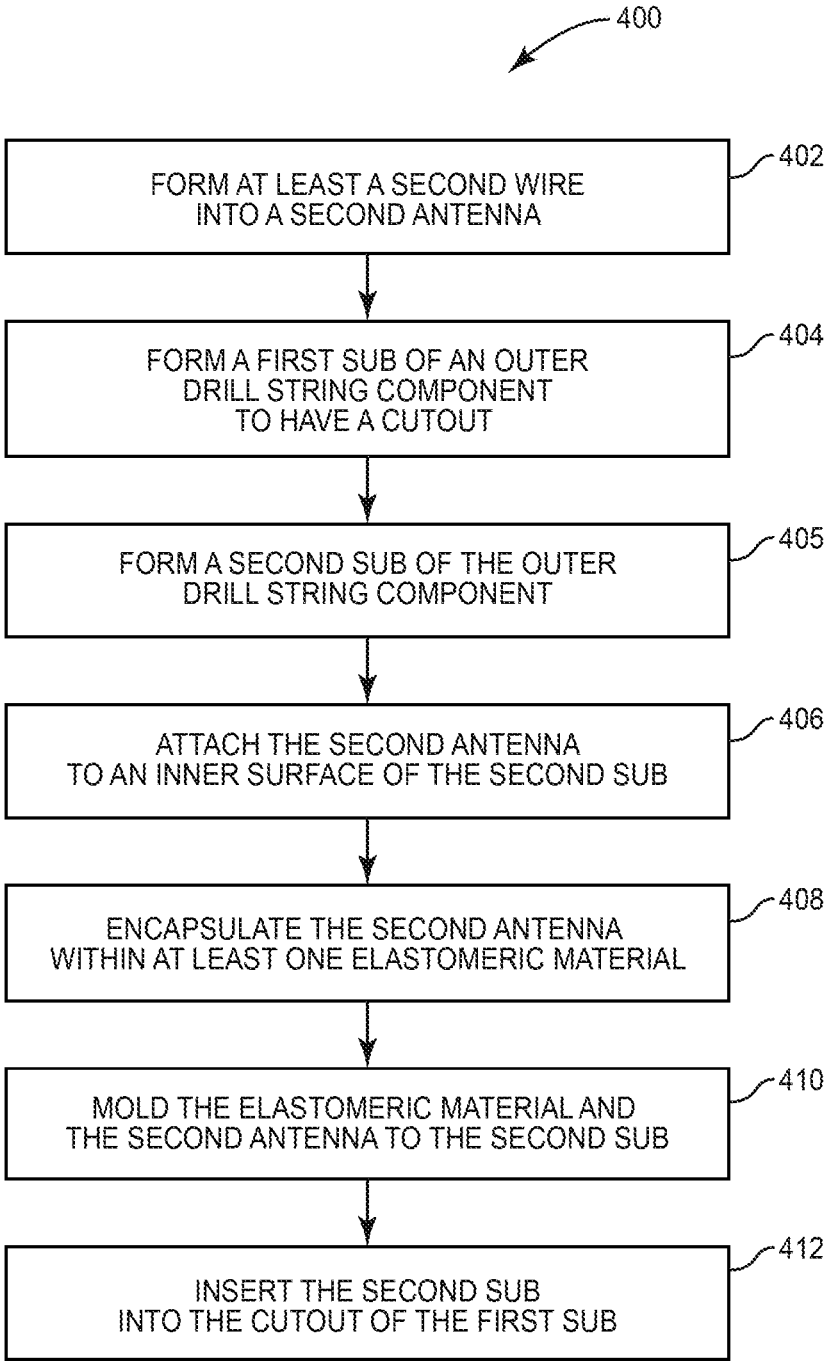
FIG. 9 is a process flow diagram illustrating a method for manufacturing the outer drill string component including the second antenna shown in FIGS. 4A and 4B.

Turning to FIGS. 8 and 9, embodiment of the present disclosure include method for assembling outer drill string components 90 and 190. Turning to FIG. 8, the method 300 includes forming 302 at least a second wire into the antenna 94. The antenna forming steps can include coating the wire with a polymeric coat and assembling wire strands into the desired wire mesh configuration. The method can include forming the outer drill string component 90 using forming techniques typical manufacturing downhole tools for a drilling system. The method can include forming 304 the downhole sub 60 of the outer drill string component 90. The forming step 304 can include defining the recess 96 adjacent the downhole end of the sub 60. The method includes forming 305 the second sub 62. Forming step 305 can include forming the cutout 69 so that the sub surface 68 can be coupled to the second sub 62 in the cutout 69. Step 306 includes attaching the antenna 94 along an inner surface 91 of the drill string component 90. For instance, the attaching step can include attaching the antenna to the sub 60 and further positioning the sub 60 in the cutout 69 such the recess and antenna 94 are disposed in the cutout 69. Prior to the when the sub 60 is coupled to sub 62, the method includes encapsulating 308 the antenna within at least one elastomeric material in the recess 96. Encapsulation can include depositing the first elastomeric material in the recess 96, positioning the antenna 94 at least partially in the first elastomeric material, and depositing the second elastomeric material in the recess 96 such that the antenna 94 is encapsulated by the first elastomeric material and the second elastomeric material. Further, the method can include compression molding 310 the elastomeric materials and the antenna 94 in the recess 96. Next, a coupling step 312 includes coupling the first sub 60 to the second sub 62 to define the outer drill string component 90.

Turning to FIG. 9, in accordance with an alternate embodiment, a method 400 can includes assembling the outer drilling string component 190. The method 400 includes forming 402 at least a second wire into the antenna 94. The method includes forming the outer drill string component 190 using typical techniques typical in manufacturing downhole tools for a drilling system. Step 404 can include forming the downhole sub 100. The forming step 404 can include defining the first and second passage portions 36 and 38 of the downhole sub 100. The forming step 404 can thus include forming the cutout 109. In step 405, the insert sub 102 is formed and fabricated. The forming step 405 includes defining a recess 96 adjacent the downhole end 106 of the insert sub 102. Step 406 includes attaching the second wire mesh along an inner surface 11 of the drill string component 190. In one example, the second wire mesh is attached to an inner surface of the insert sub 102. In step 408 the antenna 94 is encapsulated within at least one elastomeric material in the recess 96. Encapsulation can include depositing the first elastomeric material in a recess 96, positioning the antenna at least partially in the first elastomeric material, and depositing the second elastomeric material in the recess 96 such that the second wire mesh 94 is encapsulated by the first elastomeric material and the second elastomeric material. Step 410 includes compression molding the elastomeric materials and the antenna 94 in the recess 96. Next, the method step 412 includes positioning the insert sub 102 in the cutout 109 of the downhole sub 100. Thus, as the insert sub 102 is positioned in the cutout, the second antenna is being disposed at least partially in the cutout 109. The subs 100 and 102 can be fixedly coupled together.

While the disclosure is described herein using a limited number of embodiments, these specific embodiments are not intended to limit the scope of the disclosure as otherwise described and claimed herein. The precise arrangement of the various elements and order of the steps of methods described herein are not to be considered limiting. For instance, although the steps of the methods are described with reference to sequential series of reference signs and progression of the blocks in the figures, the method can be implemented in a particular order as desired.

What is claimed:

1. A method of manufacturing a communication system for a drilling system that includes a drill string configured to drill a borehole in an earthen formation, the method comprising the steps of:

attaching a first antenna to a first drill string component;

forming a second drill string component such that the second drill string component is elongate along a longitudinal direction, the second drill string component defining a passage extending along the longitudinal direction and including a first sub and a second sub, wherein the first sub is an insert sub and the second sub defines a cutout sized and configured to receive at least a portion of the first sub, wherein forming the drill string component comprises:

forming the first sub such that the first sub is configured to be coupled to the second sub and defines a recess configured to support the second antenna; and positioning the first sub at least partially in the cutout of the second sub; and attaching a second antenna to the second drill string component so that the second antenna is positioned to face the passage and is supported by the first sub, wherein the first drill string component is configured to be positioned in the passage of the second drill string component in an assembled configuration in the borehole such that the first and second antennas are within wireless communicative range with each other.

2. The method of claim 1, further comprising the steps of:

forming a recess in an outer surface of the first drill string component; and positioning the first antenna at least partially in the recess.

3. The method of claim 1, further comprising the step of encapsulating the first antenna within at least one elastomeric material.

4. The method of claim 3, further comprising the step of compression molding the first antenna within the at least one elastomeric material.

5. The method of claim 3, wherein the at least one elastomeric material is a first elastomeric material and a second elastomeric material, and wherein the step of encapsulating includes:

depositing the first elastomeric material in a recess in the outer surface of the first drill string component, wherein the first wire mesh is disposed at least partially in the first elastomeric material; and depositing the second elastomeric material in the recess such that the first wire mesh is encapsulated by the first elastomeric material and the second elastomeric material.

6. The method of claim 1, further comprising the step of positioning the second antenna at least partially in a wall of the second drill string component, such that the second antenna faces the first antenna when the drill string components are in the assembled configuration.

7. The method of claim 1, further comprising the step of encapsulating the second antenna within at least one elastomeric material.

8. The method of claim 7, further comprising the step of compression molding the at least one elastomeric material and the second antenna.

9. The method of claim 8, wherein step of encapsulating the second antenna includes encapsulating the second antenna within the at least one elastomeric material in a recess defined by an insert sub.

10. The method of claim 9, further comprising the step of compression molding the at least one elastomeric material and the second antenna in the recess.

11. The method of claim 1, wherein the second drill string component has an outer surface and an opposed inner surface, the inner surface defining the passage, the method comprising the step of forming the cutout into the inner surface of the second drill string component.

12. The method of claim 11, wherein the passage has a first portion and a second portion spaced from the first portion in the longitudinal direction, the method further comprising the step of forming the first portion to have a first dimension and the second portion to have a second dimension that is less than the first dimension, the first and second dimensions being perpendicular to the longitudinal direction, such that the first portion defines at least a portion of the cutout.

13. The method of claim 12, further comprising the steps of:

positioning the second antenna in the recess; and positioning the insert sub into the first portion of the passage.

14. A communication system for a drilling system configured to drill a borehole in an earthen formation, the communication system comprising:

a first drill string component defining an uphole end, an opposed downhole end, and an outer surface that extends between the uphole and downhole ends, the first drill string component carrying a first antenna; and a second drill string component defining an inner surface, an opposed outer surface, and a passage at least partially defined by the inner surface, the second drill string component including a second antenna disposed along the inner surface, a first sub, and a second sub coupled to the first sub, the first sub defining a recess for supporting the second antenna and including a ledge that abuts the second sub and a wall that extends from the ledge in a downhole direction, the wall at least partially defining the recess and supporting the second antenna, and the second sub defines a cutout that receives at least a portion of the wall of the first sub, wherein the first drill string component is configured to be positioned at least partially in the passage of the second drill string component in an assembled configuration in the borehole such that the first antenna and the second antenna are placed in communicative range with each other.

15. The communication system of claim 14, wherein the second drill string component is elongate along a longitudinal axis, wherein when the first and second drill string components are in the assembled configuration, the first and second antennas are aligned along a plane that is perpendicular to the longitudinal axis.

16. The communication system of claim 14, wherein the second drill string component defines an uphole end and a downhole end spaced from the uphole end in a downhole direction, the passage including a first portion and a second portion spaced from the first portion in the downhole direction toward, the first portion having a first cross-sectional dimension and the second portion having a second cross-sectional dimension that is less than the first cross-section dimension, wherein the second antenna is disposed in the first portion of the passage.

17. The communication system of claim 16, wherein the first portion of the passage is the cutout.

18. The communication system of claim 17, wherein the cutout that extends circumferentially around an entirety of the inner surface of the second drill string component.

19. The communication system of claim 14, further comprising one or more sensors in electronic communication with at least the first antenna, the one or more sensors are configured to obtain data concerning a drilling operation.

20. The communication system of claim 19, wherein the first and second antennas are configured to transmit and receive signals indicative of the data concerning the drilling operation.

21. The communication system of claim 14, wherein the first drill string component is a sonde.

22. The communication system of claim 14, wherein the second drill string component is a section of drill pipe including the first sub coupled to the second sub.

23. The communication system of claim 14, wherein the second drill string component is a section of drill collar.

24. The communication system of claim 14, wherein the second drill string component is a bottom hole assembly.

* * * * *